US009411302B2

(12) United States Patent
Ichikawa

(10) Patent No.: US 9,411,302 B2
(45) Date of Patent: Aug. 9, 2016

(54) IMAGE FORMING APPARATUS

(71) Applicant: Brother Kogyo Kabushiki Kaisha, Nagoya-shi, Aichi-ken (JP)

(72) Inventor: Hiroshi Ichikawa, Okazaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 14/665,783

(22) Filed: Mar. 23, 2015

(65) Prior Publication Data

US 2015/0331380 A1 Nov. 19, 2015

(30) Foreign Application Priority Data

May 16, 2014 (JP) ..... 2014-102318

(51) Int. Cl.
*G03G 15/00* (2006.01)
*G03G 21/16* (2006.01)

(52) U.S. Cl.
CPC ..... *G03G 21/1619* (2013.01); *G03G 15/6511* (2013.01); *G03G 21/16* (2013.01); *G03G 2215/004* (2013.01); *G03G 2221/1684* (2013.01)

(58) Field of Classification Search
CPC ..... G03G 15/6511; G03G 21/1619; G03G 2215/004; G03G 2221/1684
USPC ..... 399/393
See application file for complete search history.

(56) References Cited

U.S. PATENT DOCUMENTS

| | | | | |
|---|---|---|---|---|
| 7,606,512 | B2 | 10/2009 | Ukai et al. | |
| 2006/0067734 | A1* | 3/2006 | Igarashi et al. | 399/119 |
| 2008/0124118 | A1 | 5/2008 | Ukai et al. | |
| 2009/0213391 | A1* | 8/2009 | Ichikawa | 358/1.1 |
| 2011/0150553 | A1* | 6/2011 | Akatsuka et al. | 400/611 |
| 2012/0008998 | A1* | 1/2012 | Kannari et al. | 399/394 |
| 2012/0237279 | A1* | 9/2012 | Ichikawa | 399/388 |

FOREIGN PATENT DOCUMENTS

| | | |
|---|---|---|
| JP | 2008-134317 A | 6/2008 |
| JP | 2010-152245 A | 7/2010 |

* cited by examiner

*Primary Examiner* — Benjamin Schmitt
(74) *Attorney, Agent, or Firm* — Banner & Witcoff, Ltd.

(57) ABSTRACT

An image forming apparatus includes a sheet receiving portion configured to receive a sheet, a drum unit including a photosensitive drum configured to carry a developer image to be transferred onto the sheet, a contact member configured to contact the sheet fed from the sheet receiving portion toward the photosensitive drum, a roller configured to contact the contact member, an elastic member configured to exert an elastic force to press the contact member toward the roller, and a frame supporting the roller, the frame receiving the elastic force from the elastic member via the roller and the contact member when the roller is in contact with the contact member. The drum unit includes a restriction portion configured to restrict the frame from moving in a direction perpendicular to the width direction, the restriction portion being disposed on a side of the frame opposite to the elastic member.

18 Claims, 10 Drawing Sheets

IMAGE FORMING APPARATUS

CROSS REFERENCE TO RELATED APPLICATION

This application claims priority from Japanese Patent Application No. 2014-102318, filed on May 16, 2014, which is incorporated herein by reference in its entirety.

TECHNICAL FIELD

Aspects of the disclosure relate to an electrophotographic image forming apparatus.

BACKGROUND

A known image forming apparatus has a casing, a drawer unit including a drum unit and being detachably attached to the casing, and a conveyor unit for conveying a sheet. The conveyor unit is disposed at a position shifted from the drawer unit in a direction in which the drawer unit is attached and removed.

The drum unit includes at least a photosensitive drum. The drawer unit includes two or more drum units.

The conveyor unit includes a contact member, an elastic member, and a frame. The contact member is a member contacting a sheet to be fed, such as a roller and a separation pad. The elastic member exerts an elastic force pressing the contact member against the sheet. The frame receives the elastic force directly or indirectly.

SUMMARY

The frame is a strength member shaped like a beam extending in a width direction perpendicular to both of a sheet feed direction and a sheet thickness direction. Thus, if the frame has small bending stiffness, the frame may become greatly deformed upon receipt of the elastic force.

When the frame becomes greatly deformed, the elastic force pressing the contact member against the sheet becomes small, and improper sheet feeding easily occurs.

Illustrative aspects of the disclosure provide an image forming apparatus configured to reduce a potential of a frame from becoming greatly deformed and minimize improper sheet feeding due to deformation of the frame.

According to an Aspect of the disclosure, an image forming apparatus includes a sheet receiving portion configured to receive a sheet, a drum unit including a photosensitive drum configured to carry a developer image to be transferred onto the sheet, a contact member configured to contact the sheet fed from the sheet receiving portion toward the photosensitive drum, a roller configured to contact the contact member and to rotate in contact with the sheet to apply a feeding force to the sheet, an elastic member configured to exert an elastic force to press the contact member toward the sheet, and a frame supporting the roller. The frame receives the elastic force from the elastic member via the roller and the contact member when the roller is in contact with the contact member. The frame extends in a width direction perpendicular to a sheet feed direction and a sheet thickness direction. The drum unit is configured to move between a first position in which an image is formable and a second position shifted from the first position in a moving direction of the drum unit. The drum unit includes a restriction portion configured to restrict the frame from moving in a direction perpendicular to the width direction, the restriction portion being disposed on a side of the frame opposite to the elastic member.

With this structure, the potential of the frame from becoming greatly deformed can be reduced. Thus, improper sheet feeding due to deformation of the frame can be minimized.

BRIEF DESCRIPTION OF THE DRAWINGS

Reference is made to the following description taken in connection with the accompanying drawings, like reference numerals being used for like corresponding parts in the various drawings.

DETAILED DESCRIPTION

An illustrative embodiment of the disclosure will be described with reference to the following drawings.

In the following description, the expressions "front", "rear", "upper or top", "lower or bottom", "right", and "left" are used to define the various parts when an image forming apparatus 1 is disposed in an orientation in which it is intended to be used. In the embodiment, the image forming apparatus 1 is a color type image forming apparatus configured to form a color image.

For members or portions designated by numerals, at least one is provided unless "plural" or "two or more" is specifically stated otherwise.

Figure 1:
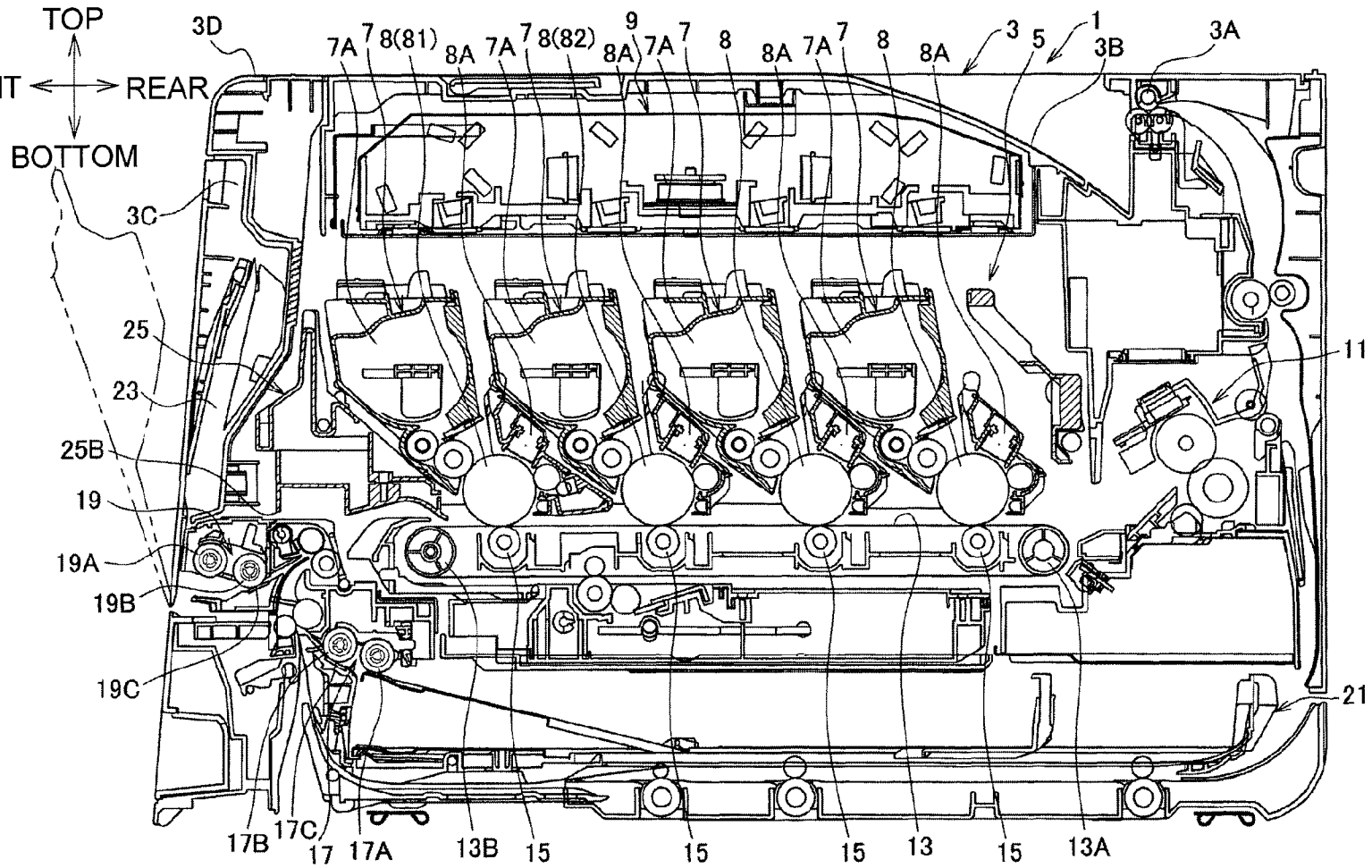
FIG. 1 is a sectional view of an image forming apparatus according to an illustrative embodiment.

As illustrated in FIG. 1, the image forming apparatus 1 includes, in a casing 3, an electrophotographic image forming unit 5 configured to form an image on a recording medium, e.g., a sheet. The image forming unit 5 includes a plurality of developing cartridges 7, a plurality of photosensitive drums 8, a plurality of chargers 8A, a light exposure unit 9, and a fixing unit 11.

The developing cartridges 7 each include a storing portion 7A in which a developer is stored. Each developing cartridge 7 or each storing portion 7A contains a different color developer (for example, one of yellow, magenta, cyan, and black).

The photosensitive drums 8 and the chargers 8A are provided in the same number as the developing cartridges 7. Each of the chargers 8A is configured to charge a corresponding one of the photosensitive drums 8. The light exposure unit 9 is configured to expose each charged photosensitive drum 8 to form an electrostatic latent image thereon.

When a developer is supplied to each photosensitive drum 8 having the electrostatic latent image formed thereon, a developer image corresponding to the electrostatic latent image is carried on an outer surface of each photosensitive drum 8. A belt 13 is a strip-shaped endless belt, extends between a roller 13B and a roller 13C, which are spaced apart from each other, and is configured to rotate. The belt 13 is configured to feed a sheet, on which an image is being formed, toward the fixing unit 11.

Transfer members 15 are disposed in one-to-one correspondence with the photosensitive drums 8 such that the belt 13 is sandwiched between each of the transfer members 15 and a corresponding one of the photosensitive drums 8. Each of the transfer members 15 is configured to transfer a developer image carried on a corresponding one of the photosensitive drums 8 to a sheet. Thus, developer images, which are carried on the corresponding photosensitive drums 8, are sequentially transferred and overlaid one over the other on a sheet conveyed on the belt 13.

The fixing unit 11 is configured to fix developer images transferred onto a sheet by heating the developer images through the application of pressure. A sheet having an image formed thereon is ejected by an ejection roller 3A onto an ejection tray 3B disposed in an upper portion of the casing 3.

A first feeder mechanism 17 and a second feeder mechanism 19 are disposed upstream from the belt 13 in a sheet feed direction. The first feeder mechanism 17 is configured to feed sheets one by one from a sheet supply tray 21 toward the image forming unit 5.

The sheet supply tray 21 is a sheet receiving portion disposed below a drum unit 25 in a vertical direction and configured to receive sheets. The sheet supply tray 21 according to the embodiment is detachably attached to a main body.

The main body refers to portions of the image forming apparatus 1, such as the casing 3 and left and right main frames (not illustrated), which cannot be disassembled by a user. The main frames are strength members to which the image forming unit 5 is assembled. The main frames are board-shaped and disposed on left and right sides of the drum unit 25 in a horizontal direction, respectively, such that the drum unit 25 is sandwiched therebetween.

Figure 2:
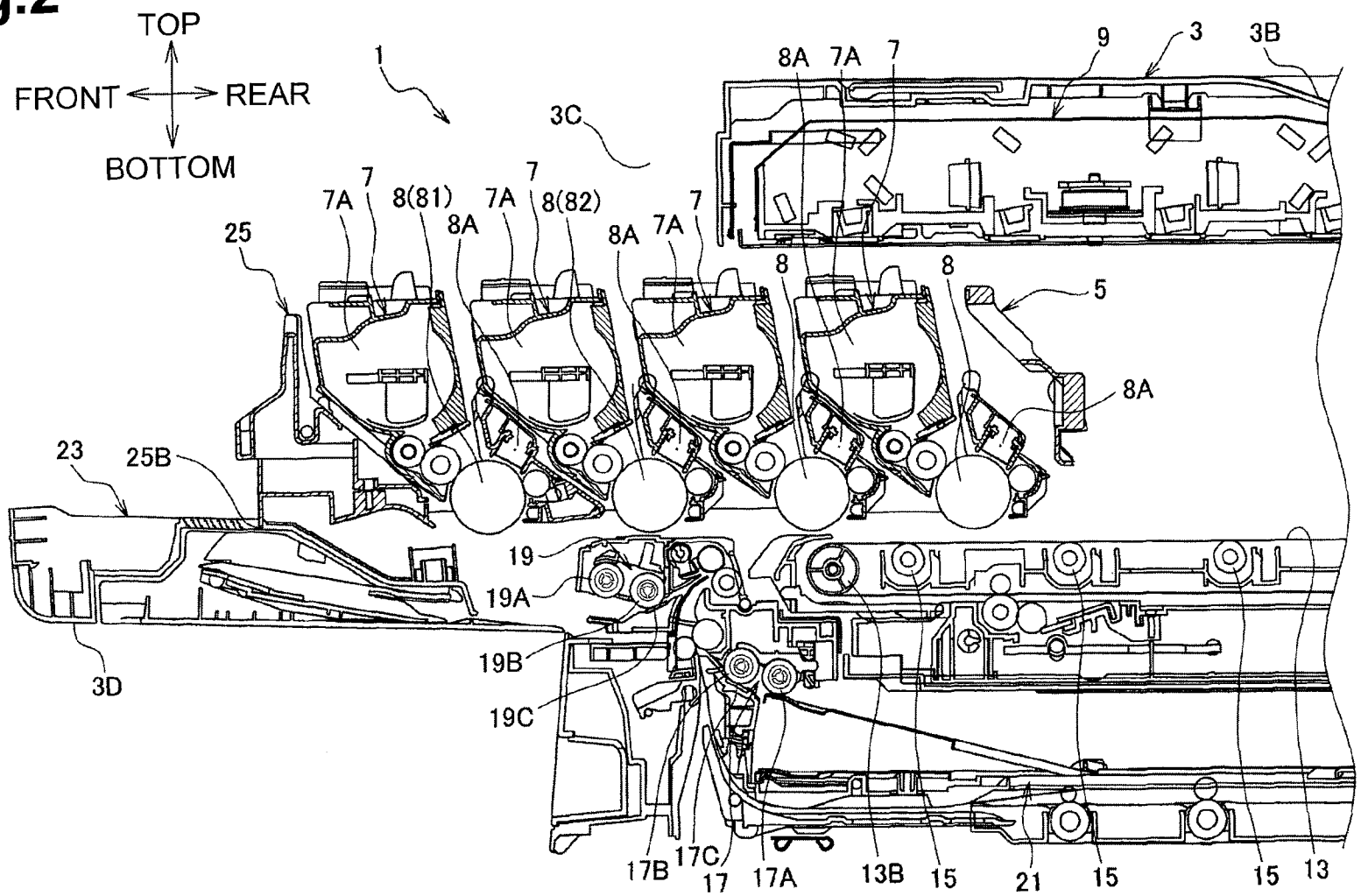
FIG. 2 is a fragmentary sectional view of the image forming apparatus according to the illustrative embodiment.

As illustrated in FIG. 2, the second feeder mechanism 19 is configured to feed sheets one by one from a multi-purpose tray 23 toward the image forming unit 5. The multi-purpose tray 23 is a sheet receiving portion configured to receive a sheet temporarily for forming an image on the sheet different from a sheet received on the sheet supply tray 21.

The multi-purpose tray 23 according to the embodiment is disposed to a front cover 3D for opening and closing an opening 3C formed at a front side of the casing 3. The front cover 3D is movable between a position to open the opening 3 (FIG. 1) and a position to close the opening (FIG. 2).

The multi-purpose tray 23 is movable independently relative to the front cover 3D between a position to open the opening 3C and a position to close the opening 3C. The multi-purpose tray 23 is available when in the position to open the opening 3C.

Figure 3:
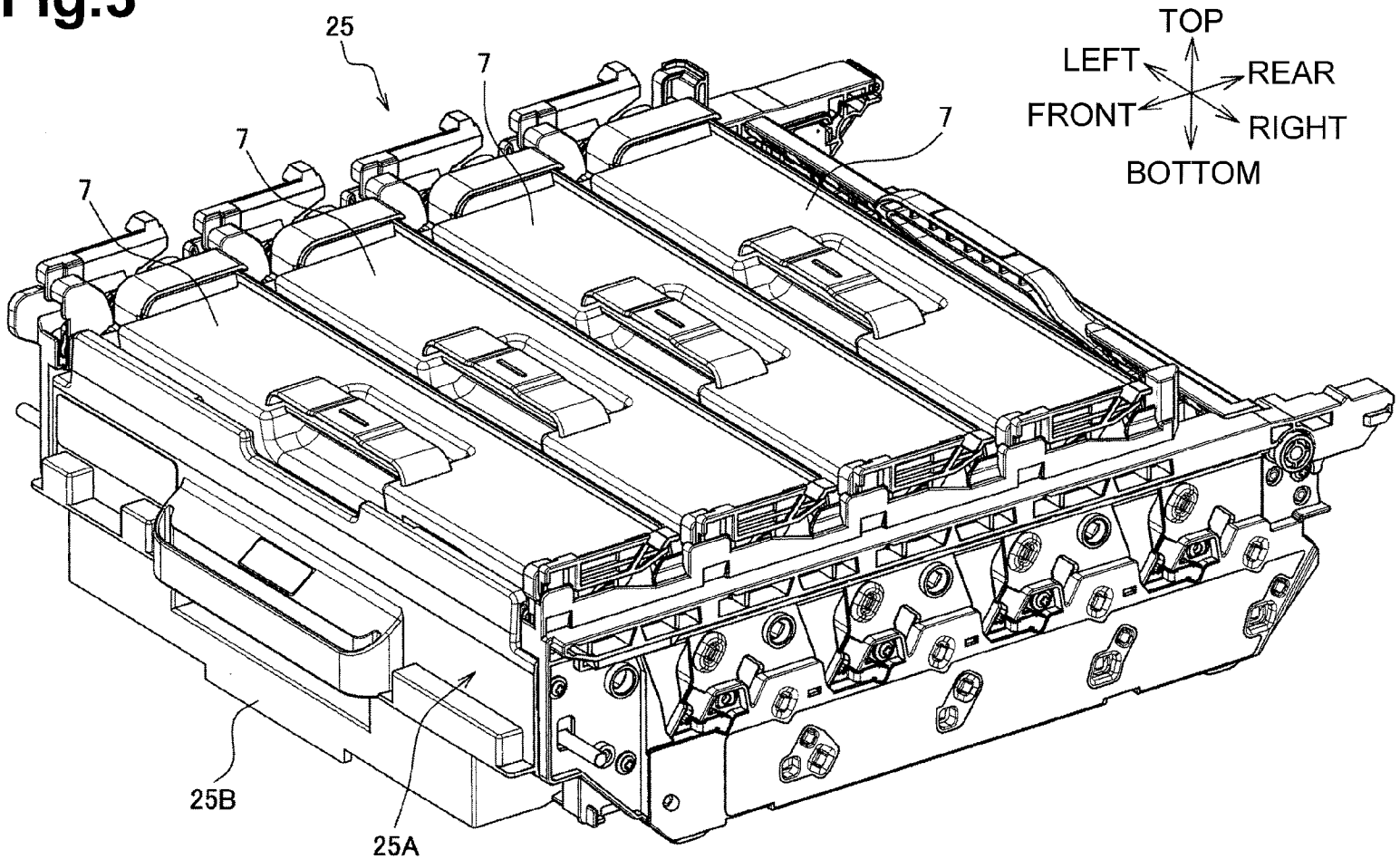
FIG. 3 is a perspective view of a drum unit according to the illustrative embodiment.

The developing cartridges 7, the photosensitive drums 8 and the chargers 8A are attached to a drawer 25A illustrated in FIG. 3. The developing cartridges 7 are detachably attachable to the drawer 25A. In other words, the drawer 25A constitutes a support member supporting each of the developing cartridges 7 detachably.

The photosensitive drums 8 and the chargers 8A are non-detachable relative to the drawer 25A except for repair. In short, the user can detach or attach the developing cartridges 7 relative to the drawer 25A, but cannot detach or attach the photosensitive drums 8 and the chargers 8A relative to the drawer 25A.

The drawer 25A is a member shaped like a box opening upward, and is movably assembled to the main body. Specifically, the drawer 25A is movable between a first position (FIG. 1) where an image is formable and a second position (FIG. 2) where the drawer is moved from the first position.

Thus, only by moving the drawer 25A relative to the main body, the user can move the developing cartridges 7, the photosensitive drums 8 and the chargers 8A simultaneously relative to the main body. Hereinafter, units unified by the drawer 25A are collectively referred to as a drum unit 25.

The drum unit 25 (the drawer 25A) according to the embodiment is detachably attachable relative to the main body. As illustrated in FIG. 2, when the front cover 3D is open and the opening 3C is open, the user can attach or remove the drum unit 25 through the opening 3C.

The first position is a position where image formation on a sheet is reliably performed. Specifically, the photosensitive drums 8 assembled to the drawer 25A are located in regular positions relative to the transfer members 15 assembled to the main body.

Figure 4:
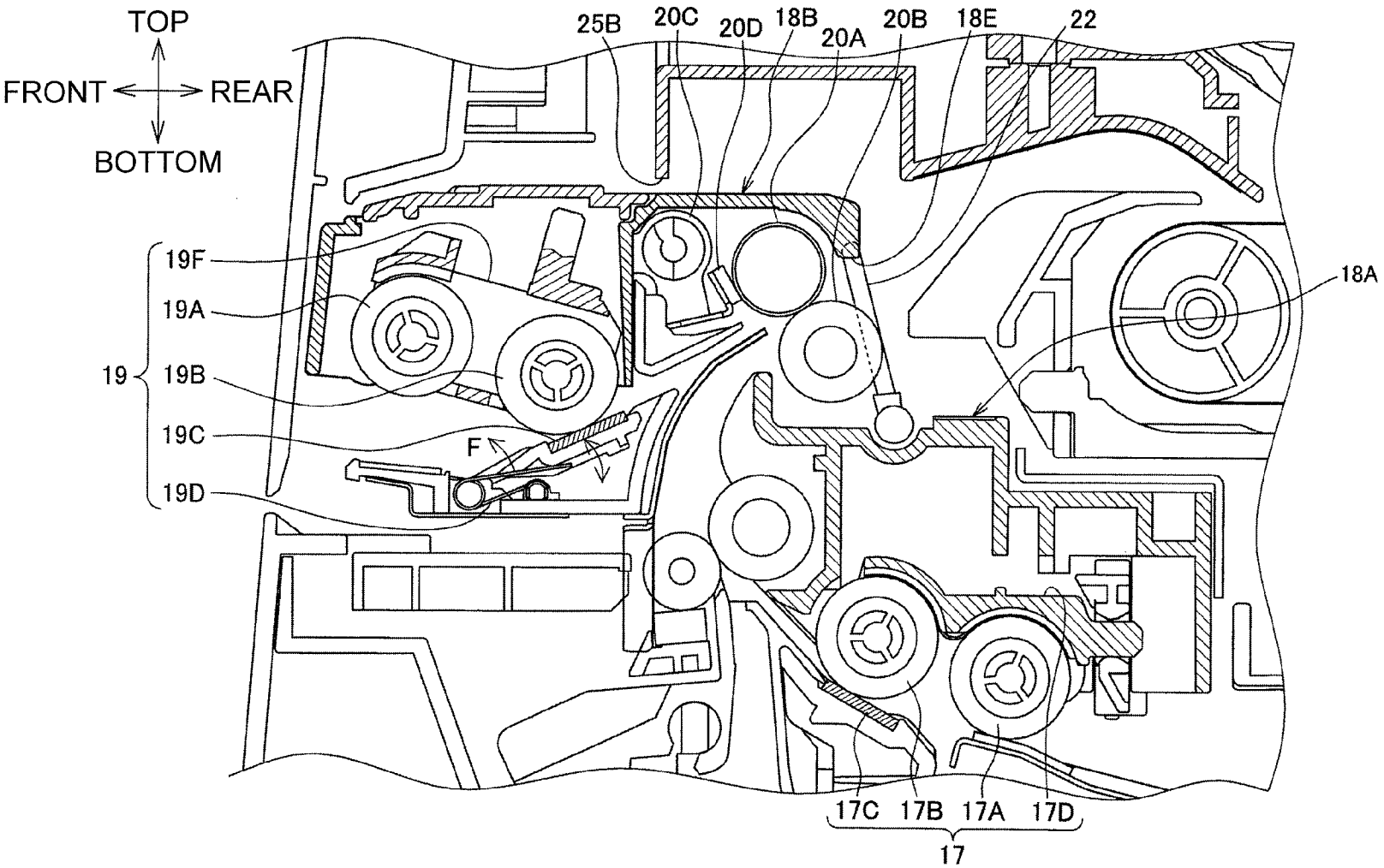
FIG. 4 is an enlarged view of a first feeder mechanism and a second feeder mechanism according to the illustrative embodiment.

As illustrated in FIG. 4, the first feeder mechanism 17 includes a pickup roller 17A, a separation roller 17B, and a separation pad 17C. The pickup roller 17A feeds at least one of sheets received in the sheet supply tray 21 toward the image forming unit 5 or the photosensitive drums 8.

The separation pad 17C functions as a contact member that contacts a sheet fed toward the photosensitive drums 8 to apply feeding resistance to the sheet. The separation roller 17B is a roller disposed facing the separation pad 17C and rotates in contact with the sheet to give a feeding force to the sheet.

With this structure, when two or more sheets are fed by the pickup roller 17A, a sheet of the two or more sheets just contacting the separation roller 17B is fed toward the photosensitive drums 8, and the remaining sheets undergo the feeding resistance directly or indirectly from the separation pad 17C and stop.

The separation roller 17B is assembled to a first sheet supply frame 18A via a drive shaft (not illustrated). The first sheet supply frame 18A is a strength member shaped like a beam extending in the width direction and left and right ends of the first sheet supply frame 18A in the extending direction are fixed to the main frames, respectively.

The width direction refers to a direction perpendicular to the sheet feed direction and a sheet thickness direction. In this embodiment, the width direction agrees with a left-right direction of the image forming apparatus 1. The drive shaft extends in the width direction, supports the separation roller 17B, and transmits a rotation force supplied from an electric motor (not illustrated) to the separation roller 17B.

The pickup roller 17A is pivotally assembled to the drive shaft via a first roller holder 17D, and receives a rotation force from the drive shaft via a rotation force transmitting portion (not illustrated) such as gears.

The separation pad 17C is movable close to or away from the separation roller 17B and pressed against a sheet by an elastic force of a spring (not illustrated). In short, the spring exerts the elastic force to move the separation pad 17C to the separation roller 17B. The separation pad 17C and the spring are assembled to the sheet supply tray 21.

Figure 5:
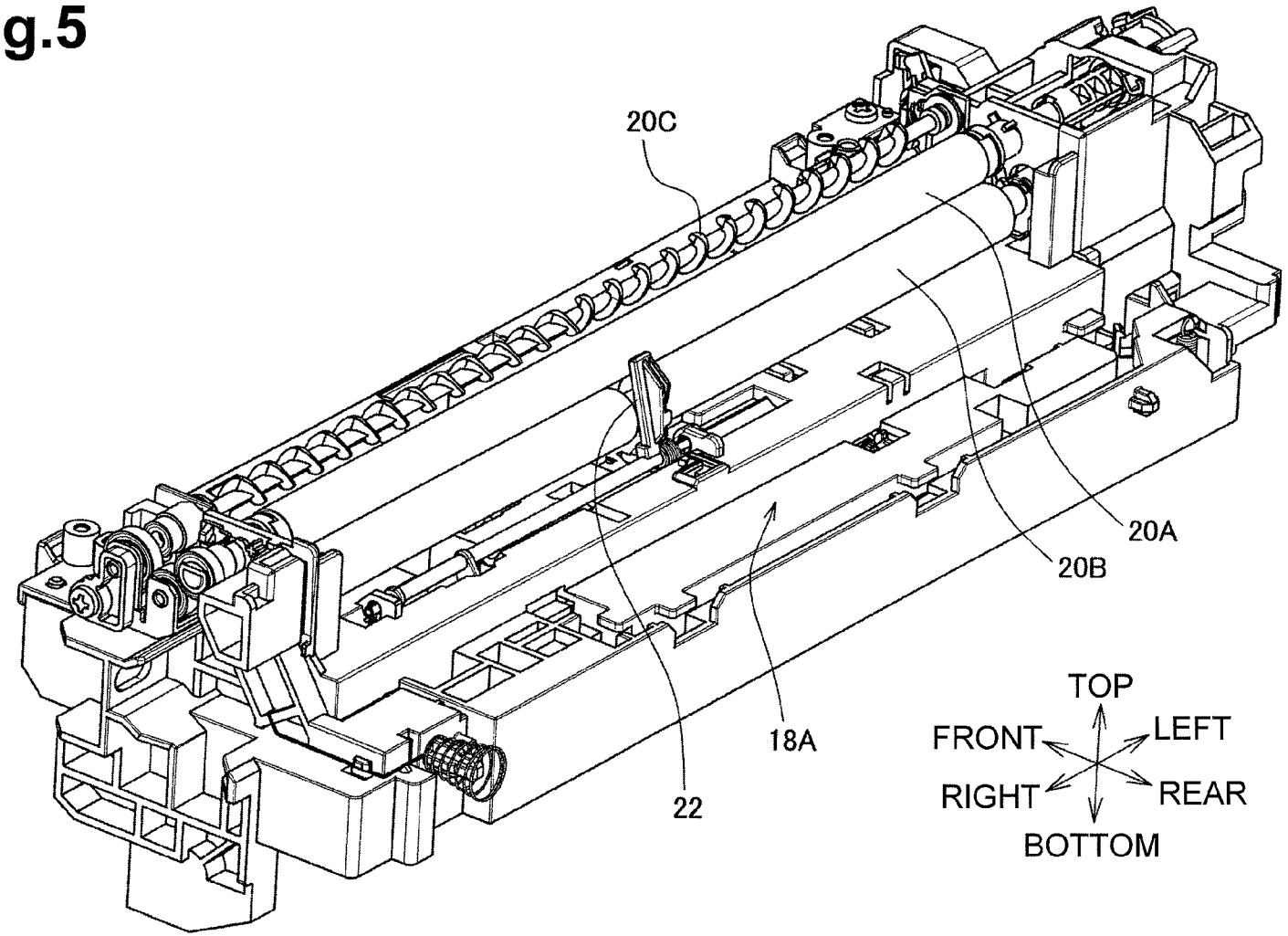
FIG. 5 is a perspective view of a first sheet supply frame according to the illustrative embodiment.

As illustrated in FIG. 5, a pair of registration rollers 20A, 20B, and an auger 20C are assembled in the first sheet supply frame 18A. The registration rollers 20A, 20B exert the following registration function.

In short, the registration rollers 20A, 20B, which stop rotating, contact a sheet fed from the first feeder mechanism 17 or the second feeder mechanism 19 to temporarily stop feeding of the sheet.

Then, the registration rollers 20A, 20B resume rotating and feed the sheet. The sheet is corrected such that the front end is oriented perpendicular to the sheet feed direction, and then enters the image forming unit 5 at a specified time.

The outer surface of the registration roller 20A is provided with a covering portion made of fluorine resin. The outer surface of the registration roller 20A is configured to slidingly contact a frictional member 20D illustrated in FIG. 4.

Thus, when the registration roller 20A rotates and the outer surface of the registration roller 20A slides on the frictional member 20D, the registration roller 20A becomes charged by friction. Static electricity builds up on the registration roller 20A, causing a suction force thereon so that foreign matter clinging to the sheet, such as paper dust particles, becomes adhered to the charged registration roller 20A.

The paper dust adhered to the registration roller 20A is scraped by the frictional member 20D and transferred by the auger 20C to a paper dust collecting portion, which is not illustrated. The auger 20C is a kind of liquid pump, e.g., a screw pump.

A movable member 22 is disposed downstream of the registration roller 20A, 20B and upstream of the image forming unit 5 in the sheet feed direction. The movable member 22 is a member that moves in contact with a sheet fed thereto for detecting presence or absence of a sheet.

Specifically, as illustrated in FIG. 4, the movable member 22 is a pivotable member such that one end is pivotally supported by the first sheet supply frame 18A and the other end is located such that the other end can contact a sheet to be fed. A shielding plate (not illustrated) is disposed on a pivot of the movable member 22 such that the shielding plate is movable together with the movable member 22.

The shielding plate moves between a light shielding position where the shielding plate shields light emitting from a photo interrupter and a position shifted from the light shielding position. Detection as to presence or absence of a sheet is made based on whether a light receiving portion of the photo interrupter receives the light. The movable member 22, the shielding plate, and the photo interrupter are collectively referred to as a post-registration sensor.

As illustrated in FIG. 4, the second feeder mechanism 19 includes a pickup roller 19A, a separation roller 19B and a separation pad 19C. The pickup roller 19A feeds at least one of sheets received in the multi-purpose tray 23 toward the image forming unit 5 or the photosensitive drums 8.

The separation pad 19C functions as a contact member that contacts a sheet fed to apply feeding resistance to the sheet. The separation roller 19B is disposed facing the separation pad 19C and rotates in contact with the sheet to give a feeding force to the sheet.

With this structure, when two or more sheets are fed by the pickup roller 19A, a sheet of the two or more sheets just contacting the separation roller 19B is fed toward the photosensitive drums 8, and the remaining sheets undergo the feeding resistance directly or indirectly from the separation pad 19C and stop.

Figure 6:
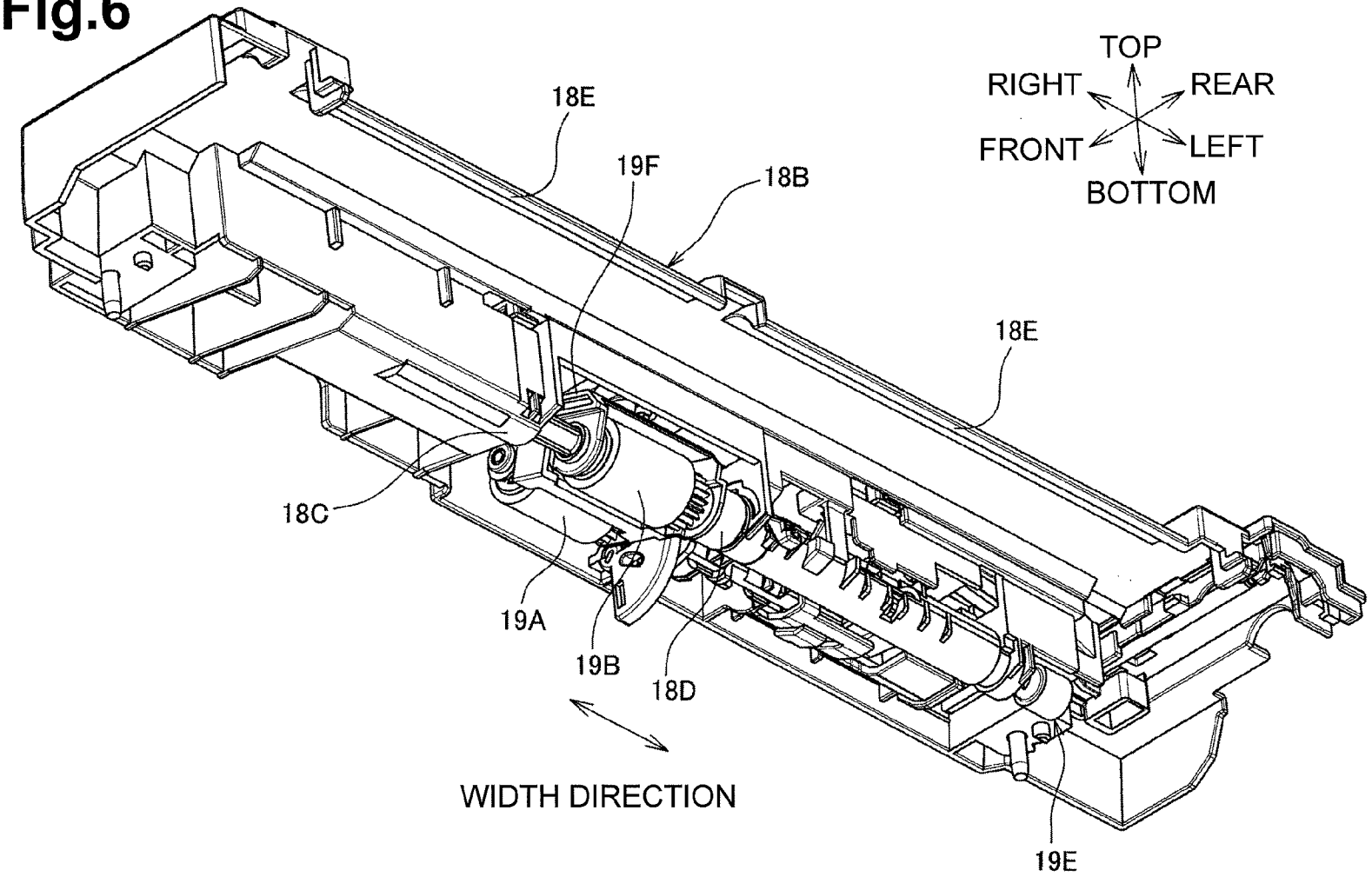
FIG. 6 is a perspective view of a second sheet supply frame according to the illustrative embodiment.

The separation roller 19B is assembled in a second sheet supply frame 18B via a drive shaft 19E illustrated in FIG. 6. The second sheet supply frame 18B is a strength member shaped like a beam extending in the width direction and left and right ends of the second sheet supply frame 18B in the extending direction are fixed to the first sheet supply frame 18A.

Thus, in the embodiment, the second feeder mechanism 19 (the second sheet supply frame 18B) and the first feeder mechanism 17 (the first sheet supply frame 18A) are unified and assembled to the main frames as one sheet supply unit.

The drive shaft 19E extends in the width direction, supports the separation roller 19B, and transmits a rotation force supplied from the electric motor (not illustrated) to the separation roller 19B. The second sheet supply frame 18B includes a first support portion 18C and a second support portion 18D, which are disposed to left and right ends of the separation roller 19B in an axial direction thereof, respectively.

The first support portion 18C and the second support portion 18D are sliding bearing members rotatably supporting the drive shaft 19E. In short, the separation roller 19B is supported via the drive shaft 19E to the second sheet supply frame 18B by the first support portion 18C and the second support portion 18D.

The pickup roller 19A is pivotally assembled to the drive shaft 19E via a second roller holder 19F, and receives a rotation force from the drive shaft 19E via a rotation force transmitting portion (not illustrated) such as gears.

As illustrated in FIG. 4, the separation pad 19C is movable close to or away from the separation roller 19B. A spring 19D is an elastic member that exerts an elastic force to press the separation pad 19C toward the sheet. In short, the spring 19D exerts elastic force F to move the separation pad 19C to the separation roller 19B.

Thus, the second sheet supply frame 18B receives the elastic force F via the separation pad 19C, the separation pad 19B and the drive shaft 19E. In short, a center portion of the second sheet supply frame 18B in the extending direction is pressed by the elastic force F from the lower side toward the upper side.

The spring 19D is assembled in the first sheet supply frame 18A via a mounting frame, not illustrated. Thus, reaction of the elastic force F is received at the first sheet supply frame 18A. The spring 19D according to the embodiment is a torsion coil spring having a coil portion. A central axis of the coil portion agrees with a central axis of the separation pad 19C.

As illustrated in FIG. 4, the second sheet supply frame 18B includes a guide portion 18E. The guide portion 18E guides a sheet fed from the sheet supply tray 21 or the multi-purpose tray 23 toward the image forming unit 5. The movable member 22 moves in contact with the sheet guided by the guide portion 18E.

Figure 7A:
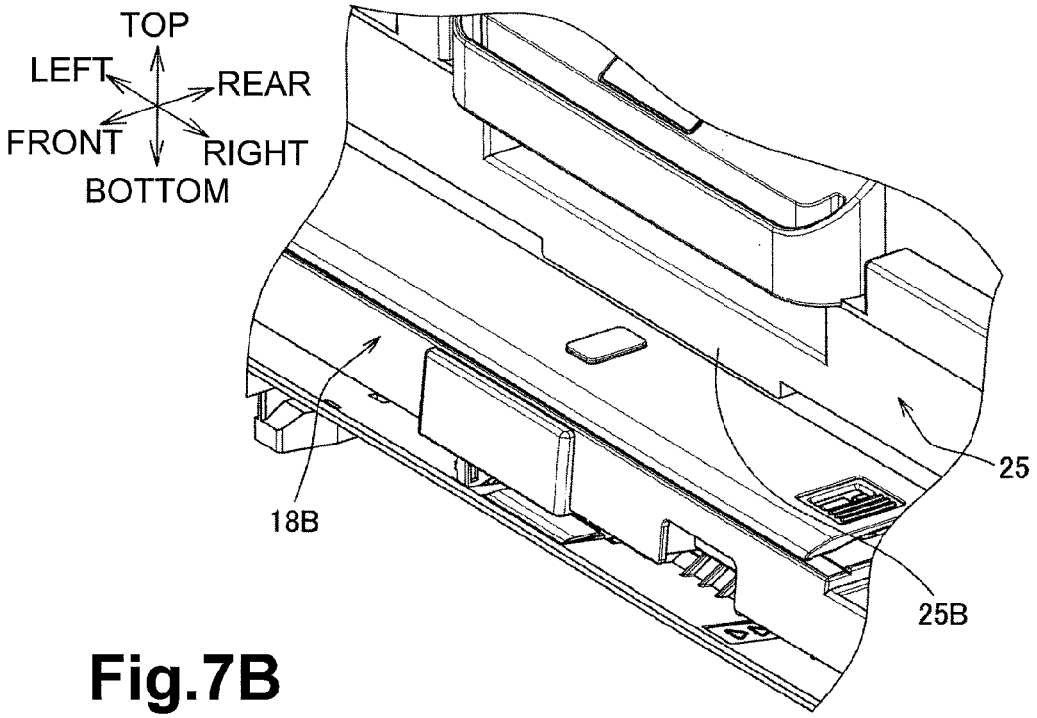
FIG. 7A is a perspective view illustrating positional relationship between the second sheet supply frame and a restriction portion.

As illustrated in FIG. 7A, the drum unit 25 (the drawer 25A) includes a restriction portion 25B. The restriction portion 25B restricts the movement of the second sheet supply frame 18B in a direction perpendicular to a longitudinal direction of the second sheet supply frame 18B, that is, in a direction of the elastic force F.

Figure 7B:
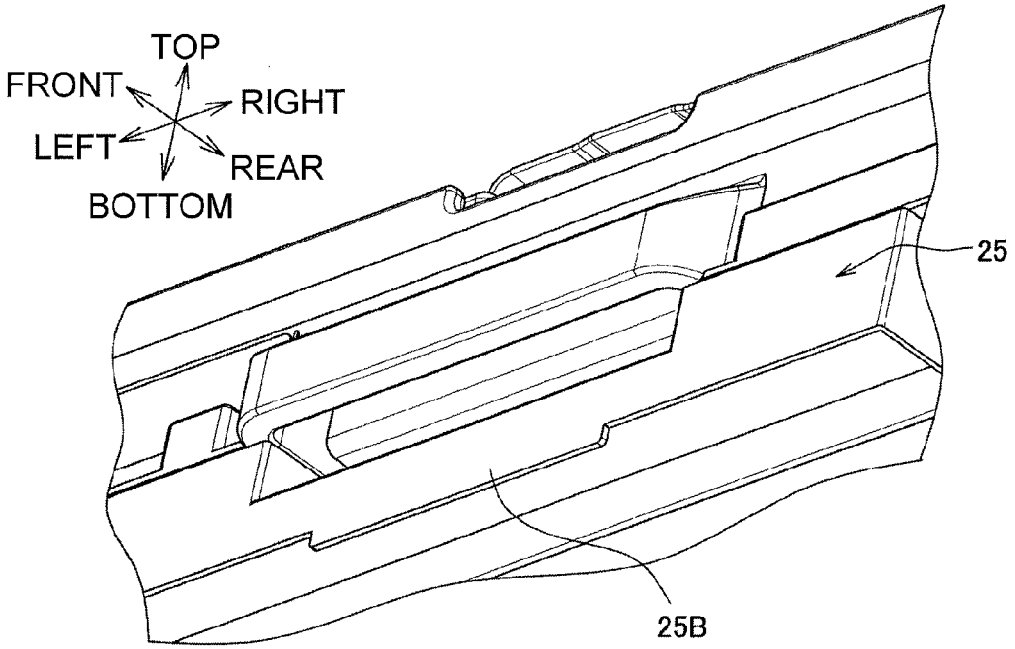
FIG. 7B is a perspective view of the restriction portion.

As illustrated in FIG. 7B, the restriction portion 25B is constituted by a protrusion protruding from the drum unit 25 (the drawer 25A) toward the second sheet supply frame 18B when the drum unit 25 is in the first position.

The restriction portion 25B according to the embodiment restricts the second sheet supply frame 18B from moving by more than a predetermined dimension. Specifically, as illustrated in FIG. 4, when the drum unit 25 is in the first position, there is a clearance between an end of the restriction portion 25B and the second sheet supply frame 18B.

Thus, even in a case where the second sheet supply frame 18B becomes deformed toward the restriction portion 25B, the second sheet supply frame 18B contacts the restriction portion 25B to restrict further deformation of the second sheet supply frame 18B. In short, the amount of deformation of the second sheet supply frame 18B is restricted to be lower than or equal to the dimension for the clearance.

The restriction portion 25B is located above the second sheet supply frame 18B in the vertical direction. The drum unit 25 (the drawer 25A) has sufficiently high stiffness and mass compared with the second sheet supply frame 18B.

For this reason, the drum unit 25 (the drawer 25A) is not deformed, nor moved upwardly by a force to deform the second sheet supply frame 18B, that is, the elastic force F.

As illustrated in FIG. 1, the restriction portion 25B is disposed on a side of the frontmost photosensitive drum 81 opposite to the photosensitive drum 82 adjacent to the photosensitive drum 81. Specifically, the restriction portion 25B is disposed to one end of the drum unit 25 in a moving direction thereof (toward the opening 3C in the embodiment).

In short, as illustrated in FIG. 1, the drum unit 25 includes the photosensitive drums 8 and the photosensitive drums 8 are arranged in a direction perpendicular to axial directions of the respective photosensitive drums 8, that is, in the moving direction of the drum unit 25 (the front-rear direction in the embodiment).

Of the photosensitive drums 8, a photosensitive drum 8 located at an end in an arrangement direction where the photosensitive drums 8 are arranged is regarded as a most-end photosensitive drum (81, in the embodiment, disposed at the left end of the FIG. 1), and a photosensitive drum 8 adjacent to the most-end photosensitive drum 81 is regarded as an adjacent photosensitive drum (82, in the embodiment, the second one from the left end of FIG. 1). The restriction portion 25B is disposed on a side of the most-end photosensitive drum 81 opposite to the adjacent photosensitive drum 82.

Figure 8:
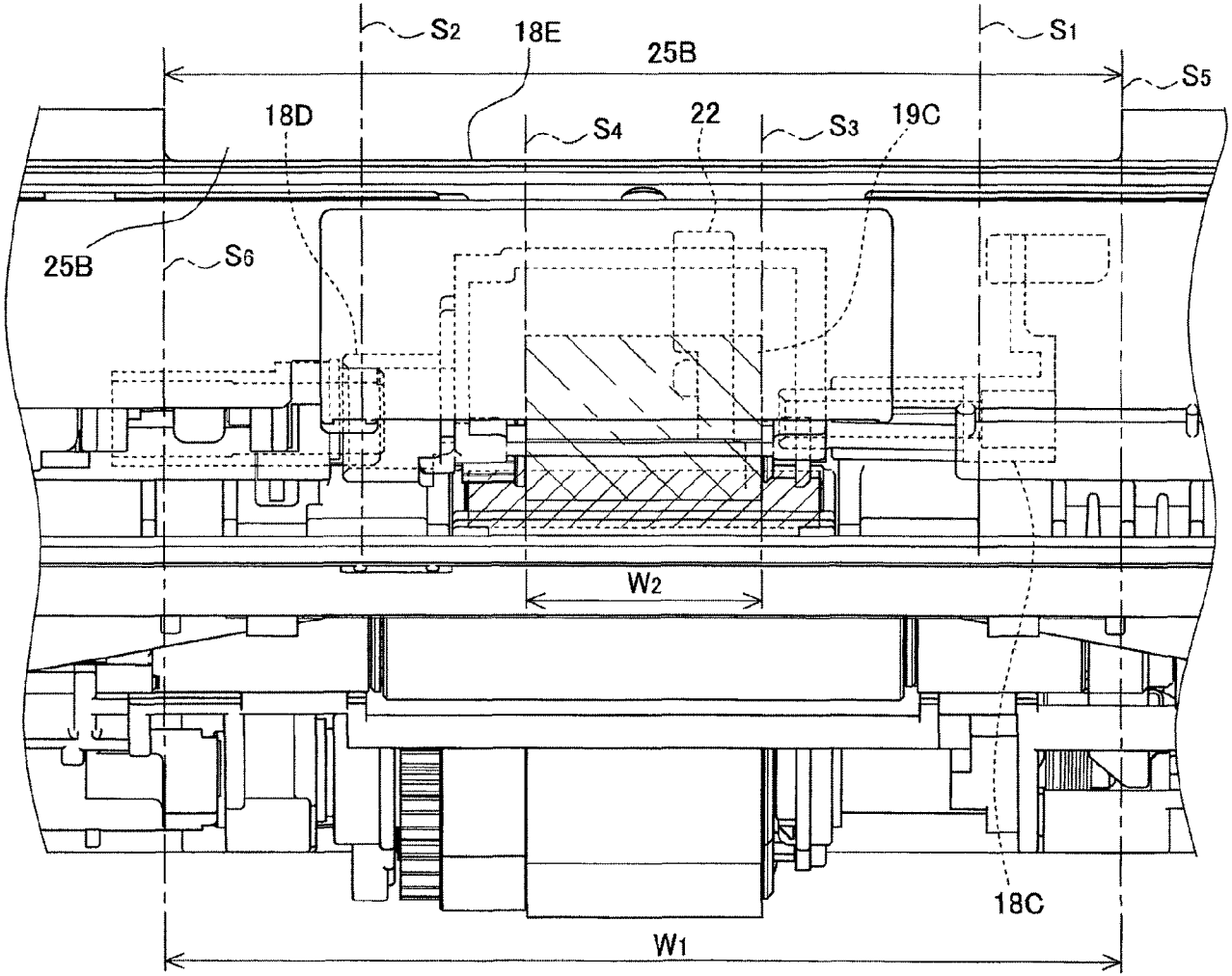
FIG. 8 illustrates an arrangement of the restriction portion, a separation pad, a first support portion and a second support portion.
Figure 9:
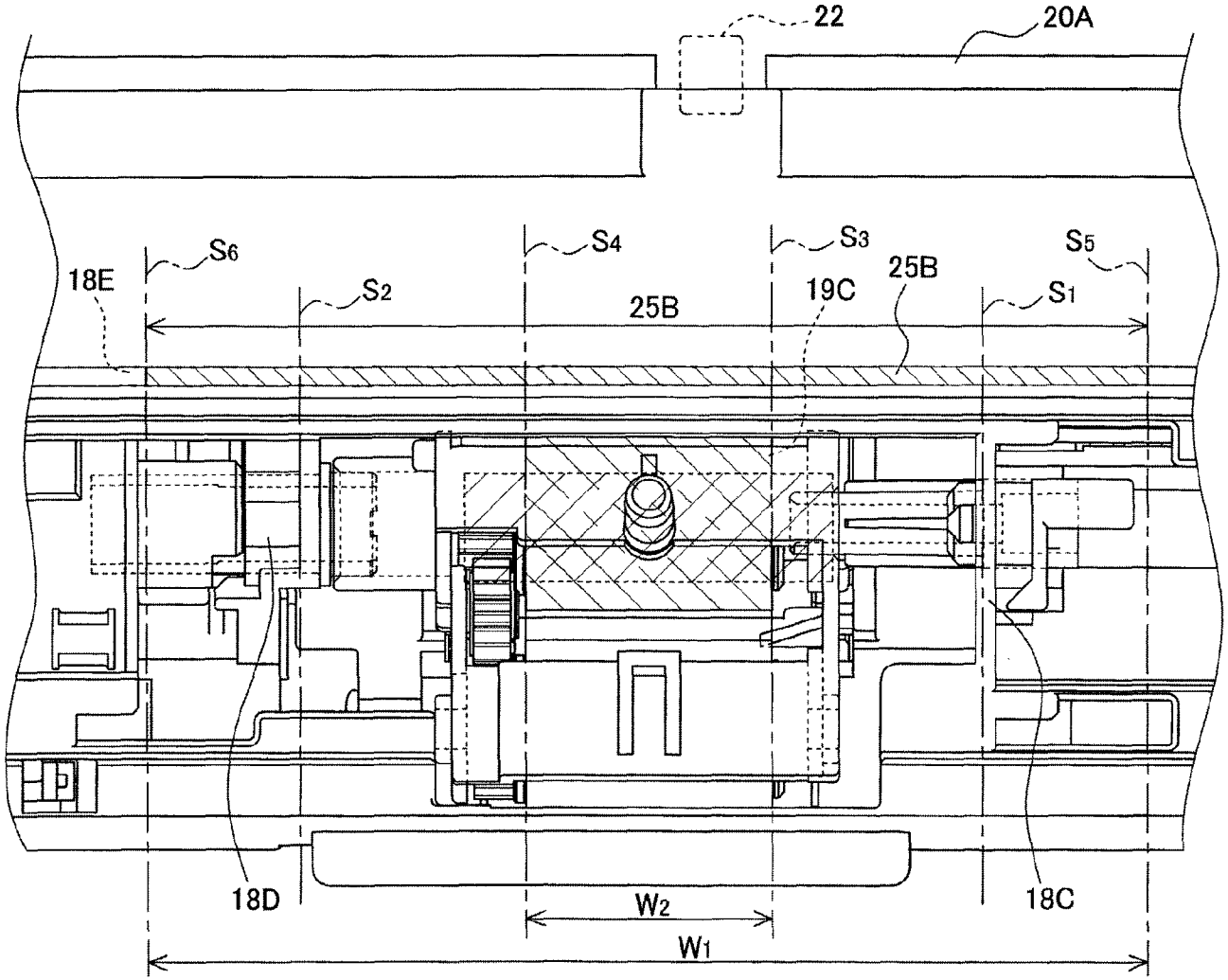
FIG. 9 illustrates an arrangement of the restriction portion, the separation pad, the first support portion and the second support portion.

In the embodiment, as illustrated in FIG. 8, an outer dimension W1 of the restriction portion 25B of which is parallel to the width direction is greater than an outer dimension W2 of the separation pad 19C of which is parallel to the width direction. When the drum unit 25 is in the first position, the following three requirements are satisfied in the embodiment:

First, at least a part of the restriction portion 25B is disposed between a first imaginary plane S1 and a second imaginary plane S2 (see FIG. 8). Second, at least a part of the restriction portion 25B is disposed between a third imaginary plane S3 and a fourth imaginary plane S4 (see FIG. 9). Third, the movable member 22 is disposed between a fifth imaginary plane S5 and a sixth imaginary plane S6 (see FIG. 8).

The first imaginary plane S1 is an imaginary plane, which is perpendicular to the axial direction of the separation roller 19B (a direction parallel to the width direction in the embodiment) and includes the first support portion 18C. The second imaginary plane S2 is an imaginary plane, which is perpendicular to the width direction and includes the second support portion 18D.

The third imaginary plane S3 is an imaginary plane, which is perpendicular to the width direction and includes one end of the separation pad 19C in the width direction. The fourth imaginary plane S4 is an imaginary plane, which is perpendicular to the width direction and includes the other end of the separation pad 19C in the width direction.

The fifth imaginary plane S5 is an imaginary plane, which is perpendicular to the width direction and includes one end of the restriction portion 25B in the width direction. The sixth plane S6 is an imaginary plane, which is perpendicular to the width direction and includes the other end of the restriction portion 25B in the width direction.

In the embodiment, the drum unit 25 includes the restriction portion 25B that restricts the second sheet supply frame 18B from moving in a direction perpendicular to the longitudinal direction.

With this structure, as the restriction portion 25B restricts the deformation of the second sheet supply frame 18B beyond the specified dimension, the second sheet supply frame 18B does not become greatly deformed. Thus, improper sheet feeding resulting from the excessive deformation of the second sheet supply frame 18B can be minimized.

The disclosure is effective especially for an image forming apparatus, as in the image forming apparatus 1 according to the embodiment, in which the drum unit 25 moves above the second sheet supply frame 18B when the drum unit 25 is pulled out of the casing 3.

If the vertical dimension of the second sheet supply frame 18B is increased unconditionally in order to enhance the stiffness of the second sheet supply frame 18B, the vertical dimension of the image forming apparatus 1 is increased.

In the embodiment, as the restriction portion 25B of the drum unit 25 restricts the deformation of the second sheet supply frame 18B, the need to increase the vertical dimension of the second sheet supply frame 18B can be reduced and improper sheet feeding resulting from the deformation of the second sheet supply frame 18B can be reduced.

In the embodiment, the elastic force F of the spring 19D acts on the second sheet supply frame 18B via the first support portion 18C and the second support portion 18D. Thus, a portion of the second support portion 18B corresponding to an area between the first imaginary plane S1 and the second imaginary plane S2 may become most greatly deformed.

In the embodiment, however, as the restriction portion 25B is disposed between the first imaginary plane S1 and the second imaginary plane S2, the deformation of the second sheet supply frame 18B can be reliably restricted.

In the embodiment, the elastic force F of the spring 19D acts on the second sheet supply frame 18B via the separation pad 19C. Thus, the second sheet supply frame 18B may be deformed such that a portion thereof corresponding to a space between the first imaginary plane S1 and the second imaginary plane S2 is most greatly deformed.

In the embodiment, however, as at least a part of the restriction portion 25B is disposed between the third imaginary plane S3 and the fourth imaginary plane S4, the deformation of the second sheet supply frame 18B can be reliably restricted.

In the embodiment, the outer dimension W1 of the restriction portion 25B of which is parallel to the width direction is greater than the outer dimension W2 of the separation pad 19C of which is parallel to the width direction. With this structure, the deformation of the second sheet supply frame 18B can be reliably restricted.

The restriction portion 25B according to the embodiment is disposed above the second sheet supply frame 18B in the vertical direction.

With this structure, in the embodiment, if the restriction portion 25B is pressed upward in the vertical direction by the deformation of the second sheet supply frame 18B, the second sheet supply frame 18B can be pressed downward in the vertical direction by the gravity acting on the drum unit 25 and thus the deformation of the second sheet supply frame 18B can be reliably restricted.

In the embodiment, as the second sheet supply frame 18B includes the guide portion 18E, if the second sheet supply frame 18B becomes excessively deformed, it is difficult to feed a sheet through a proper sheet feed path.

If a sheet is fed through a path shifted from the proper sheet feed path, the movable member 22 cannot be brought in contact with the sheet properly, resulting in failure in detecting presence or absence of the sheet.

Figure 10:
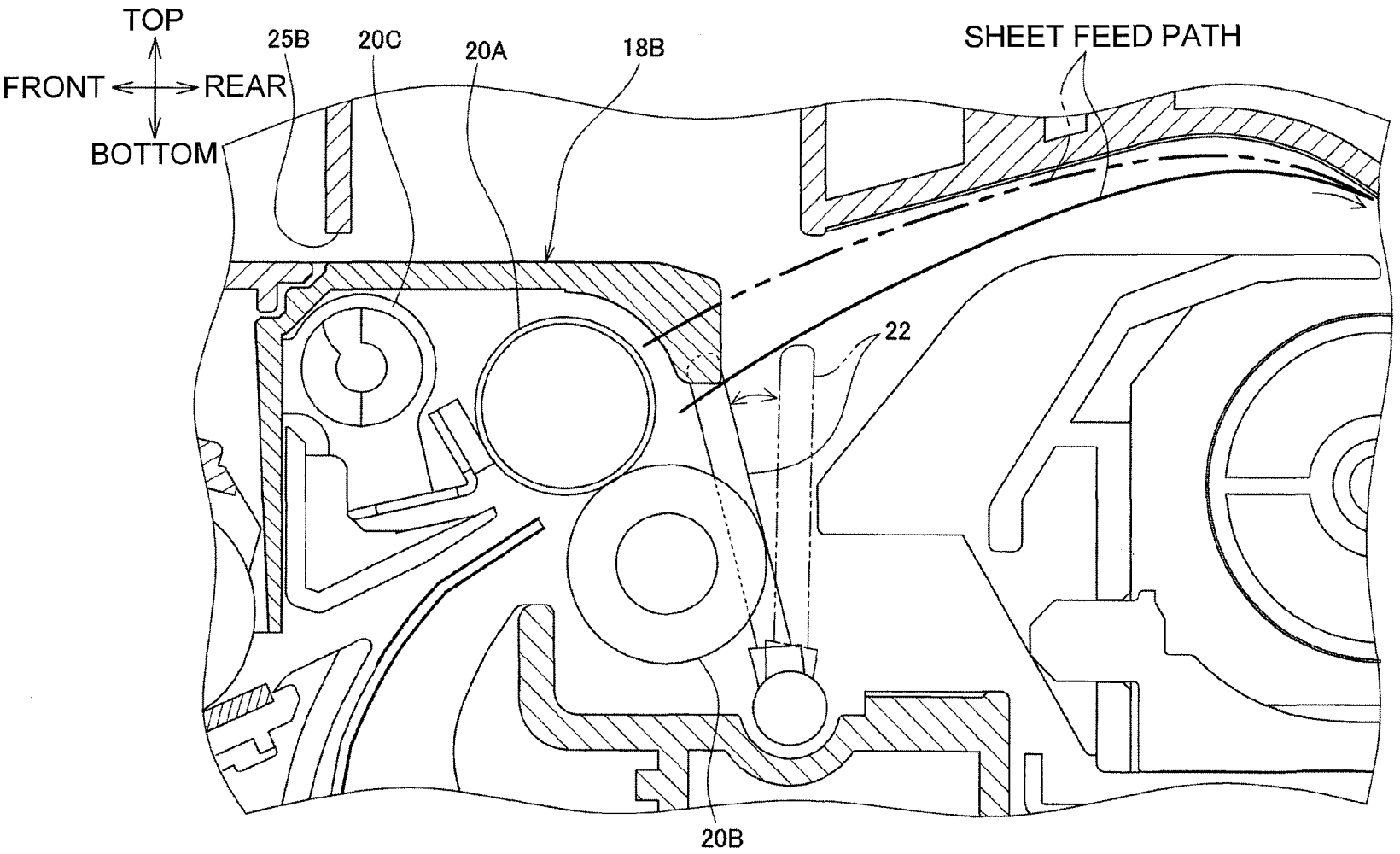
FIG. 10 illustrates a sheet is fed from the second sheet supply frame.

In short, when the amount of deformation of the second sheet supply frame 18B is small and the position of the guide portion 18E is not greatly shifted from the regular position or when the guide portion 18E is in the regular position, the sheet fed by the guide portion 18E is fed as illustrated by a solid line in FIG. 10.

However, if the amount of deformation of the second sheet supply frame 18B becomes great and the position of the guide portion 18E is shifted greatly upward from the regular position, the sheet fed by the guide portion 18E is fed as illustrated by a two-dot chain line in FIG. 10.

Thus, when the amount of deformation of the second sheet supply frame 18B becomes great, a trailing end portion of the sheet in the sheet feed direction is separated from the movable member 22 at an early time compared with a case in which the second sheet supply frame 18B does not become deformed. This will result in failure in detecting the presence or absence of the sheet.

In the embodiment, however, as the second sheet supply frame 18B is restricted from becoming excessively deformed, sheets can be fed through a proper sheet feed path. As the movable member 22 is disposed between the fifth imaginary plane S5 and the sixth imaginary plane S6, the presence or absence of the sheet can be detected.

The above embodiment shows, but is not limited to, the restriction portion 25B restricting the second sheet supply frame 18B from moving. The restriction portion 25B may restrict the first sheet supply frame 18A from moving.

The above embodiment shows, but is not limited to, that there is a clearance between the restriction portion 25B and the second sheet supply frame 18B. The restriction portion 25B and the second sheet supply frame 18B may contact each other with the contact pressure being greater than or equal to zero.

The above embodiment shows, but is not limited to, that, when the drum unit 25 is in the first position, at least a part of the restriction portion 25B is disposed between the first imaginary plane S1 and the second imaginary plane S2.

The above embodiment shows, but is not limited to, that, when the drum unit 25 is in the first position, at least a part of the restriction portion 25B is disposed between the third imaginary plane S3 and the fourth imaginary plane S4.

The above embodiment shows, but is not limited to, that, when the drum unit 25 is in the first position, the movable member 22 is disposed between the fifth imaginary plane S5 and the sixth imaginary plane S6.

The above embodiment shows, but is not limited to, the separation pad 19C as a contact member. Instead, a retard roller, a reverse roller, a reverse belt, or a gate roller may be used as a contact member.

The above embodiment shows, but is not limited to, the restriction portion 25B being disposed in a front portion of the drum unit 25 (the drawer 25A). For example, if the second sheet supply frame 18B is disposed to a rear portion of the casing 3, the restriction portion 25B may be disposed in a rear portion of the drum unit 25 (the drawer 25A).

The embodiment shows, but is not limited to, the image forming apparatus 1 including the photosensitive drums 8 for forming images in color. The disclosure may be applied to an image forming apparatus for forming images in monochrome.

The above embodiment shows, but is not limited to, the drum unit 25 being detachably attachable to the main body. The drum unit 25 may only move relative to the main body.

While the features herein have been described in connection with various example structures and illustrative aspects, it will be understood by those skilled in the art that other variations and modifications of the structures and aspects described above may be made without departing from the scope of the inventions described herein. Other structures and aspects will be apparent to those skilled in the art from a consideration of the specification or practice of the features disclosed herein. It is intended that the specification and the described examples only are illustrative with the true scope of the inventions being defined by the following claims.

What is claimed is:

1. An image forming apparatus configured to form an image on a sheet electrophotographically, the image forming apparatus comprising:

a main body;

a first sheet receiving portion detachably attached to a lower portion of the main body and configured to receive sheets;

a second sheet receiving portion protruding from the main body and configured to receive sheets;

an image forming unit disposed in the main body and configured to form an image on a sheet fed from the first sheet receiving portion and further form an image on a sheet fed from the second sheet receiving portion, the image forming unit including a drum unit, the drum unit including a photosensitive drum configured to carry a developer image to be transferred onto the sheet fed from the second sheet receiving portion, the drum unit being configured to move between a first position in which an image is formable and a second position shifted from the first position in a moving direction of the drum unit;

a first feeder mechanism configured to feed the sheets one by one from the first sheet receiving portion toward the image forming unit;

a second feeder mechanism configured to feed the sheets one by one from the second sheet receiving portion toward the image forming unit, the second feeder mechanism including:

a contact member configured to contact the sheet fed from the second sheet receiving portion toward the photosensitive drum;

a separation roller configured to contact the contact member and to rotate in contact with the sheet such that the separation roller and the contact member separate the sheet from the sheets received on the second sheet receiving portion; and a frame supporting the separation roller; and an elastic member configured to exert an elastic force to press the contact member toward the separation roller, wherein the frame receives the elastic force from the elastic member via the separation roller and the contact member when the separation roller is in contact with the contact member, the frame extending in a width direction parallel to an axial direction of the separation roller, and wherein the drum unit includes a restriction portion configured to restrict deformation of the frame in a direction perpendicular to the width direction, the restriction portion being disposed facing the frame supporting the separation roller for separating the sheet from the sheets received on the second sheet receiving portion protruding from the main body.

2. The image forming apparatus according to claim 1, further comprising first and second support portions included in the frame and configured to support first and second ends of the separation roller in the axial direction of the separation roller, respectively, wherein the contact member is configured to apply a feeding resistance to the sheet, and wherein, when the drum unit is in the first position, at least a part of the restriction portion is disposed between a first plane and a second plane, the first plane being perpendicular to the axial direction and including the first support portion, the second plane being perpendicular to the axial direction and including the second support portion.

3. The image forming apparatus according to claim 1, wherein the contact member includes a separation pad configured to contact the sheet to apply a feeding resistance to the sheet.

4. The image forming apparatus according to claim 1, wherein, when the drum unit is in the first position, at least a part of the restriction portion is disposed between a first plane and a second plane, the first plane being perpendicular to the width direction and including one end of the contact member in the width direction, the second plane being perpendicular to the width direction and including the other end of the contact member in the width direction.

5. The image forming apparatus according to claim 1, wherein an outer dimension of the restriction portion in the width direction is greater than an outer dimension of the contact member in the width direction.

6. The image forming apparatus according to claim 1, wherein the restriction portion is disposed above the frame in a vertical direction.

7. The image forming apparatus according to claim 6, wherein the restriction portion is spaced apart from the frame in the vertical direction.

8. The image forming apparatus according to claim 1, further comprising:

a guide portion included in the frame and configured to guide the sheet fed from the second sheet receiving portion toward the photosensitive drum; and a movable member for detecting presence or absence of a sheet, the movable member being configured to move in contact with the sheet guided by the guide portion, wherein, when the drum unit is in the first position, the movable member is disposed between a first plane and a second plane, the first plane being perpendicular to the width direction and including one end of the restriction portion, the second plane being perpendicular to the width direction and including the other end of the restriction portion.

9. The image forming apparatus according to claim 8, wherein the first sheet receiving portion includes a sheet supply tray disposed below the drum unit in a vertical direction and configured to receive sheets, and wherein the guide portion is configured to guide a sheet fed from the sheet supply tray toward the drum unit.

10. The image forming apparatus according to claim 9, wherein the second sheet receiving portion includes a multi-purpose tray disposed above the sheet supply tray in the vertical direction, and wherein the guide portion is configured to guide a sheet fed from the multi-purpose tray toward the drum unit.

11. The image forming apparatus according to claim 1, wherein the drum unit further includes another photosensitive drum, the photosensitive drum and the another photosensitive drum being arranged in an arrangement direction perpendicular to an axial direction of each of the photosensitive drum and the another photosensitive drum, the photosensitive drum being disposed closer to an end portion of the drum unit than the another photosensitive drum in the arrangement direction, and wherein the restriction portion is disposed on a side of the photosensitive drum opposite to the another photosensitive drum in the arrangement direction.

12. The image forming apparatus according to claim 1, wherein the drum unit has a front end and the restriction portion is disposed below the front end.

13. The image forming apparatus according to claim 1, wherein the restriction portion of the drum unit protrudes downward.

14. An image forming apparatus configured to form an image on a sheet electrophotographically, the image forming apparatus comprising:

a main body;

a first sheet receiving portion detachably attached to a lower portion of the main body and configured to receive sheets;

a second sheet receiving portion protruding from the main body and configured to receive sheets;

an image forming unit disposed in the main body and configured to form an image on a sheet fed from the first sheet receiving portion and further from an image on a sheet fed from the second sheet receiving portion, the image forming unit including a drum unit, the drum unit including a photosensitive drum configured to carry a developer image to be transferred onto the sheet fed from the second sheet receiving portion, the drum unit being configured to move between a first position in which an image is formable and a second position shifted from the first position in a moving direction of the drum unit;

a first feeder mechanism configured to feed the sheets one by one from the first sheet receiving portion toward the image forming unit; and a second feeder mechanism configured to feed the sheets one by one from the second sheet receiving portion toward the image forming unit, the second feeder mechanism including:

a contact member configured to contact the sheet fed from the second sheet receiving portion toward the photosensitive drum;

a separation roller configured to contact the contact member and to rotate in contact with the sheet such that the separation roller and the contact member separate the sheet from the sheets received on the second sheet receiving portion; and a frame supporting the separation roller, the frame receiving a pressing force from the contact member via the separation roller when the separation roller is in contact with the contact member, the frame extending in a width direction parallel to an axial direction of the separation roller, wherein the drum unit includes a restriction portion configured to restrict deformation of the frame in a direction perpendicular to the width direction, the restriction portion being disposed facing the frame supporting the separation roller for separating the sheet from the sheets received on the second sheet receiving portion protruding from the main body.

15. The image forming apparatus according to claim 14, wherein the contact member includes a separation pad configured to contact the sheet to apply a feeding resistance to the sheet.

16. The image forming apparatus according to claim 14, wherein the drum unit has a front end and the restriction portion is disposed below the front end.

17. The image forming apparatus according to claim 14, wherein the restriction portion of the drum unit protrudes downward.

18. The image forming apparatus according to claim 14, further comprising:

a guide portion included in the frame and configured to guide the sheet fed from the first sheet receiving portion toward the drum unit, wherein the first sheet receiving portion includes a sheet supply tray disposed below the drum unit in a vertical direction, wherein the second sheet receiving portion includes a multi-purpose tray disposed above the sheet supply tray in the vertical direction, and wherein the guide portion is configured to guide a sheet fed from the multi-purpose tray toward the drum unit.

* * * * *